United States Patent [19]

McIntyre et al.

[11] 4,277,301

[45] Jul. 7, 1981

[54] WIDE-BAND AND CONTINUOUS LINE ADHESIVE APPLICATOR FOR CIGARETTE FILTER ATTACHMENT AND THE LIKE

[75] Inventors: Donald B. McIntyre; Frederic S. McIntyre, both of Wellesley Hills, Mass.

[73] Assignee: Acumeter Laboratories, Inc., Newton Lower Falls, Mass.

[21] Appl. No.: 69,973

[22] Filed: Aug. 27, 1979

[51] Int. Cl.[3] ..... B65C 3/12; B05B 1/14; B05B 9/12

[52] U.S. Cl. ..... 156/446; 131/69; 118/56; 118/247; 118/411; 156/215; 156/291; 156/475; 156/578; 427/285; 427/286; 427/288; 427/358

[58] Field of Search ..... 118/56, 411, 412, 410, 118/415, 253, 247; 427/285, 286, 288, 358; 131/29, 24, 69; 156/578, 215, 291, 475, 446

[56] References Cited

U.S. PATENT DOCUMENTS

| | | | |
|---|---|---|---|
| 2,029,922 | 2/1936 | Heckel et al. | 118/253 X |
| 2,833,242 | 5/1958 | Neidich et al. | 118/412 |
| 3,106,481 | 10/1963 | Sorg | 118/411 X |
| 3,556,832 | 1/1971 | Park | 118/441 X |
| 3,679,476 | 7/1972 | Oosterhout et al. | 118/411 X |
| 4,020,194 | 4/1977 | McIntyre et al. | 427/286 X |
| 4,082,059 | 4/1978 | McIntyre et al. | 118/253 |
| 4,090,520 | 5/1978 | McIntyre et al. | 131/69 X |
| 4,104,431 | 8/1978 | Luke | 427/288 X |
| 4,142,010 | 2/1979 | Pipkin et al. | 118/410 X |
| 4,156,398 | 5/1979 | McDaniel | 427/286 X |

FOREIGN PATENT DOCUMENTS

| | | | |
|---|---|---|---|
| 1262475 | 2/1972 | United Kingdom | 118/7 |

*Primary Examiner*—Shrive P. Beck

*Attorney, Agent, or Firm*—Rines and Rines, Shapiro and Shapiro

[57] ABSTRACT

This disclosure involves periodically bumping webs such as a cigarette filter paper or the like against a shear surface disposed beyond a multi-nozzle adhesive extruder to provide longitudinally intermittent bands of adhesive coatings for the filters or the like, with optional provision for continuous marginal lines of adhesive along and between the bands for adhesion on the head and tail ends of such filters or other articles as well.

9 Claims, 4 Drawing Figures

WIDE-BAND AND CONTINUOUS LINE ADHESIVE APPLICATOR FOR CIGARETTE FILTER ATTACHMENT AND THE LIKE

The present invention is concerned with fluid adhesive and similar applicator systems and methods, being more specifically directed to providing wide-band and continous strip or bead adhesive patterns upon cigarette filter tip paper webs and the like; such being effected with the aid of fine multi-orificed nozzles through which adhesive materials are simultaneously metered to generate pluralities of parallel fine adhesive beads upon such webs which are merged into uniform continuous transverse coating bands that can be intermittently produced, and that can be supplemented, where desired, by continuous longitudinal adhesive strips, lines or beads, all for the adhering of cigarette filter tip papers and the like to the filter and related structures.

As described in our prior U.S. Pat. Nos. 3,595,204; 3,323,510 and 3,174,689, hot and cold adhesive applicators can be designed to produce a wide range of configurations of adhesive lines, dots, bands, etc. upon continuous paper or other webs drawn past appropriate nozzles thereof through which the adhesive, or other liquid, may be meter-pumped in a controlled manner. In applications such as the delicate attachment of filter tip papers to cigarettes and the like, very uniform and exactly positioned coating layers and strips may be required which are not in and of themselves producable from a plurality of closely spaced, small nozzle orifices, extending transversely of the web, and extruding separate successive beads of adhesive. It is, moreover, sometimes required that the coating layers be produced in an exact, controlled, longitudinally intermittent pattern corresponding to abutted filter tips; and that longitudinal continuous marginal and internal adhesive strips be also simultaneously provided for edge sealing of the tip paper when wrapped about the filters.

It is to these and related problems, accordingly, that the present invention is principally directed; it being an object of the invention to provide a new and improved adhesive applicator of the multi-orifice nozzle type, and method of operating the same, to produce such continuous exact transverse patterns of longitudinally intermittently deposited coatings and, if desired, simultaneous strips or beads, as for such applications as cigarette-to-filter adhesion and the like.

Another object is to provide a novel fluid adhesive or similar applicator of more general usefulness, also.

Other and further objects are hereinafter explained, being more fully set forth in the appended claims. In summary, from one of its broader aspects, however, the invention contemplates a fluid adhesive applicator and the like having, in combination, a plurality of fine-orifice closely spaced nozzles disposed in a plane extending transversely of a predetermined region; pumping means for simultaneously supplying the nozzles with the fluid adhesive; means for drawing a web of material-to-be-coated longitudinally through said predetermined region in juxtaposition to the orifices of said nozzles simultaneously to receive therefrom a corresponding plurality of closely spaced beads of adhesive upon the web and extending transversely across said web; shear edge means disposed a short distance longitudinally beyond said orifices; and periodically activated bumper means disposed on the opposite side of the web from the edge means for bumping said plurality of adhesive beads carried by the web against said edge means to cause spreading of the beads into longitudinally intermittent bands of adhesive ranging from bands of parallel stripes corresponding to the said beads to merged-uniform continuous coating bands. Best mode constructions and preferred embodiment details are subsequently presented.

The invention will now be described with reference to the accompanying drawings, FIG. 1 of which is a combined schematic and isometric diagram illustrating the invention, in preferred form, as applied to the illustrative application of adhesive layers upon cigarette filter tipping paper and the like;

Figure 1:
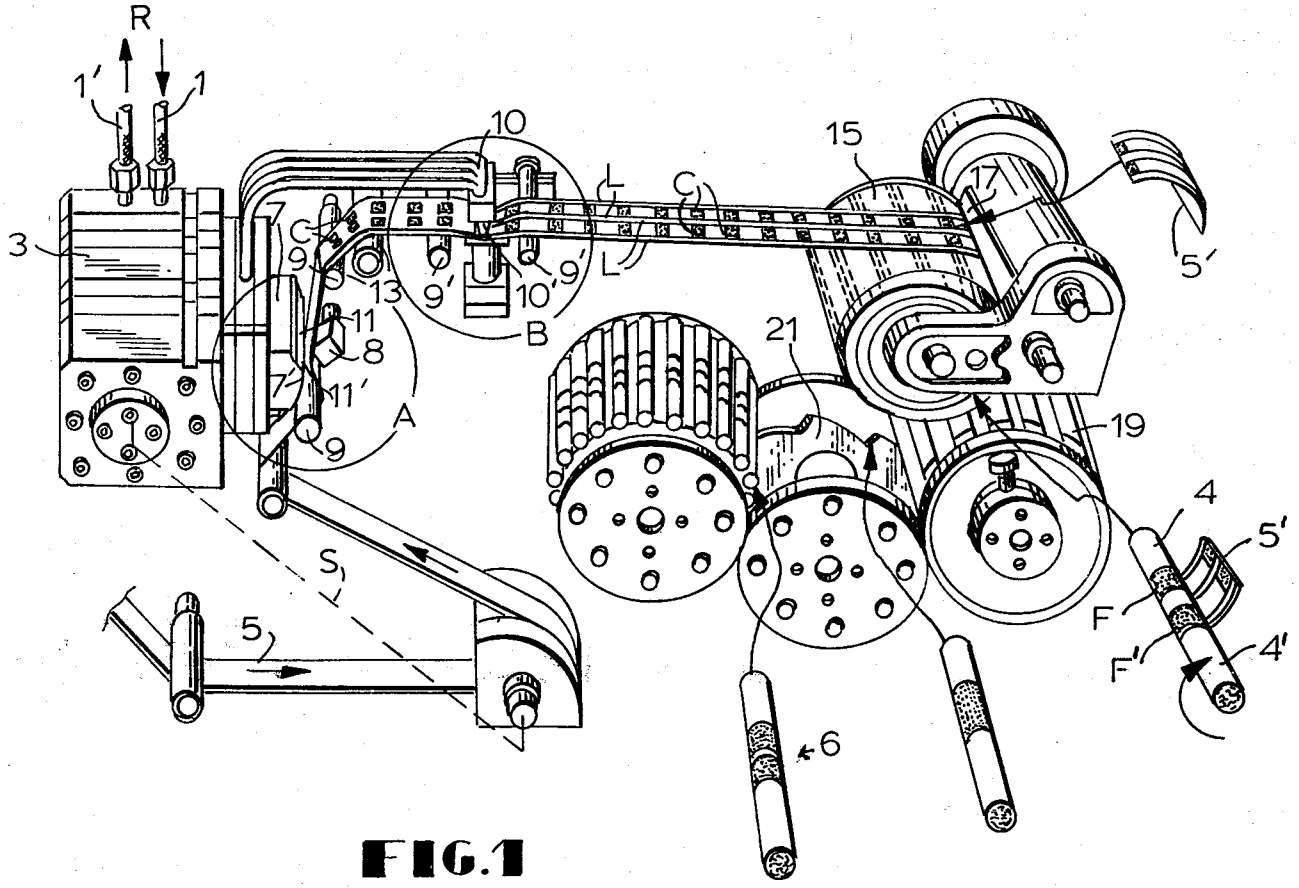

Turning, now, to the system of FIG. 1, the liquid adhesive from a reservoir R is fed along a supply line 1 into a positive displacement gear metering pump 3, driven synchronously by a direct machine drive, schematically illustrated at S, which also drives the paper or other web 5, such as the exemplary cigarette filter tipping paper web. Suitable metering pumps of this character are described in said Letters Patent and elsewhere, and include, for example, Acumeter (Newton Lower Falls, MASS.) Models 1BUP2, 1BUP4 and 1BUP24 of the assignee of the present invention. The latter model will pump 0.6 cc per ½ revolution input per nozzle discharge. Appropriate cold adhesives for normal cigarette filter tipping applications and the like are polyvinyl acetate resin emulsions, such as HR Fuller No. 1503 and Swift & Co. No. 2802AX. The metering pump 3 therefor is shown applying the fluid to a novel dispensing head 7, having a transverse line of a plurality of relatively small coplanar nozzle discharge or extrusion orifices 7' through which the adhesive is simultaneously extruded as a corresponding plurality of beads in response to the metered pumping. The return line from the pump 3 to the reservoir R is shown at 1'.

Figure 2:
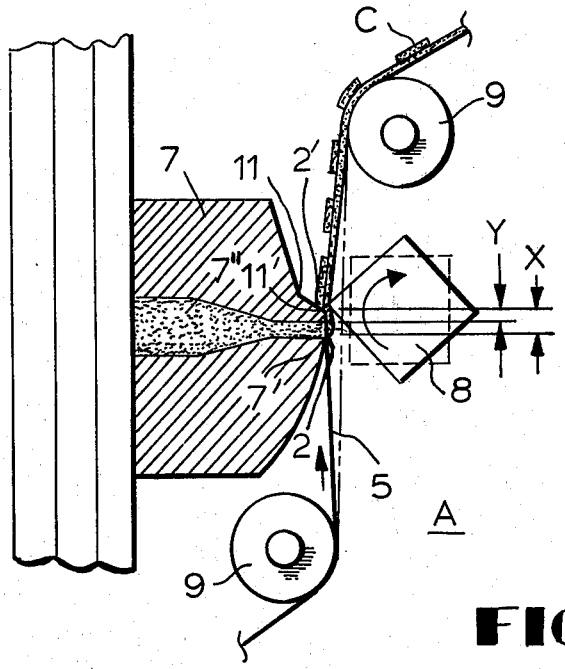
FIG. 2 is a view, upon an expanded scale, partly longitudinally sectionalized, of the nozzle extruding, shearing and bumping section A of FIG. 1.

In accordance with the invention, the transverse line of fine, closely spaced, orifices 7', one of which is more particularly shown in FIG. 2 as each preceded by a converging extrusion nozzle section 7'' within the head 7, is oriented substantially parallel (or at a slight angle) to the paper or other web 5, drawn longitudinally upwardly past the predetermined region of the orifices 7' between web support bars 9. The extrusion nozzle head 7 is provided within a short distance beyond the plane of the orifices 7', upward in the direction of web travel, say within a thirty-second of an inch or so, with an L-shaped recess 11 defining a shearing edge 11' against which the juxtaposed web 5 may be bumped periodically by the successive corners of a rotating bumper roll 8. The bumping may also be synchronously activated, as described in our U.S. Pat. Nos. 4,020,194 and 4,082,059. At the time of such bumping pressure, the web carrying the transverse plurality of adhesive beads 2 extruded from the nozzle orifices 7', will become sheared under tension at 11' into any desired degree of spreading, ranging from slight spreading producing parallel longitudinal lines, strips or beads, to merging, as at 2', FIG. 2, into a uniform full coating C. That coating C may be transversely divided into two separated halves or sections, as shown, for a purpose later explained, by dividing the plurality of nozzle orifices 7' into two transversely separated sets of orifices. There may be some applications, however, where it is not desired to have the individual globules of extruded adhesive totally merged into a continuous coating. By adjusting the tension and/or angle of travel of the web beyond the orifices 7'', under action of the shearing edge 11', the globules may be distorted or elongated to any degree and with any desired separation.

The positional relationship between the bumping point (or axis) and the nozzle orifice center line, indicated by the dimension X in FIG. 2, and the nozzle land dimension to the shearing edge 11', indicated by Y, enable control over the degree of spreading of the orifice beads to produce such parallel lines of different widths or continuous, uniform bands C—both being produced periodically intermittently at the times of the bumping actions as the successive corners of the bumper roll 8 engage the web 5 with the shearing edge 11'. To increase the longitudinal length of the intermittent bands C, the dimension Y may be increased and the dimension X, decreased. On the other hand, for narrower intermittent bands C, the dimension X will be increased and/or Y, decreased. As discussed in the above-mentioned bumper patents, furthermore, the web 5 may be directed in at an acute angle of, say, about 15°, more or less, with respect to the vertical, as illustrated.

The intermittent adhesive uniform and continuous coating bands C on the web 5, are cut into sections, schematically shown at 5' to the right in FIG. 1, by a rotary knife cylinder 17 cooperating with a vacuum drum 15; and the cut sections 5' are carried down to an adjacent cigarette-carrying drum 19 such that the sections 5' will wrap around the two butted filters F and F' of the double cigarettes 4—4', for sealing there-around. The wrapped filter sections are then slit at 6 by an intermediate cutting knife 21 to provide a severed pair of cigarettes, as described in our further U.S. Pat. No. 4,090,520, and as is well-known, with the slitter cutting in the non-adhesive area between the coatings C. This coated pattern, moreover, allows the tipping paper to "breath", permitting more air to circulate through a filter during smoking of the same.

Figure 3:
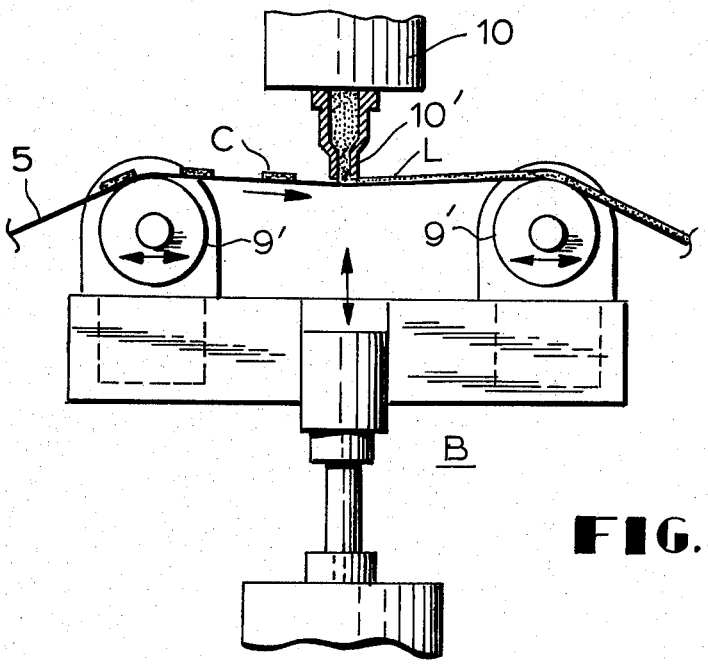
FIG. 3 is a view similar to FIG. 2 of an expanded section B for supplemental continuous longitudinal adhesive strip of bead application.
Figure 4:
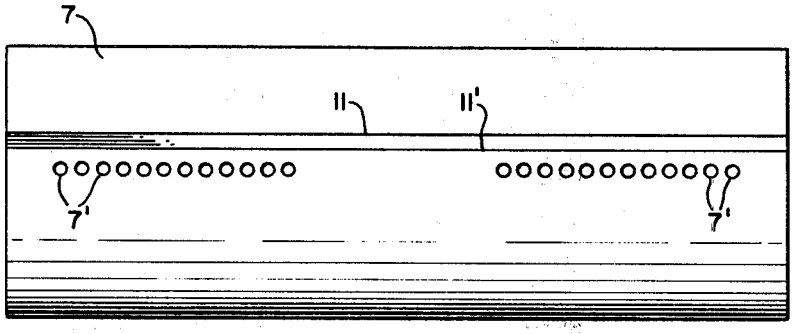
FIG. 4 is a view of the nozzle extruding device.

In the event that supplemental head and tail sealing is also desired at the ends of the filters F and F', continuous longitudinal adhesive lines or beads L may be provided, connecting the outer and inner edges of the transversely spaced intermittent bands C, by a further extrusion nozzle head 10 at station B, FIGS. 1 and 3; the orifices 10' of four nozzle openings required for the line or longitudinal beads L, being fed from the same metering pump 3, synchronously with the extrusion nozzle head 7. The web bars 9' of the extrusion nozzle station B, FIGS. 1 and 3, that carry the web laterally past the nozzle head 10, may be adjustable as illustrated to retract at machine shut-down to bring the web away from the nozzle head.

Line speeds of the order of 80 meters per minute can readily be obtained with the above type of system, using orifices 7' of the order of 2 mm. in diameter, spaced 2 mm. apart and in two in-line sets of a dozen each, and with cigarette filter paper of about 0.05 mm. in thickness. Polyvinyl acetate adhesives of the before-mentioned types have an approximate elongation ratio of 1000 to 2000%, thus permitting the spreading of the adhesive to a very finite and controlled coating film thickness. With a four-cornered bumper B positioned as before described and operated at a speed of 250 feet per minute, bands C approximately about 5 mm. in width, for example, can accurately be repeated at longitudinal spacings of approximately 2.54 cm. for the above purposes.

A further feature of this invention, as distinguished from prior gravure adhesive applicators and the like, resides in the obviating of the problem of adjusting the adhesive properties to enable a desired compromise between tack and adhesion in view of the very different properties of the dissimilar material multi-elements of the cigarette and, for example, the acetate adhesive. The invention, on the contrary, enables any adhesive property variation to be effected for any desired result in view of the inherent nature of the extrusion and shearing process thereof.

While the invention has been described in connection with the utilization of cold adhesives, furthermore, which are preferred for the above utilization, it is to be understood that the method and apparatus of the invention are also useful with hot-melt adhesives and other fluids wherein performance analagous thereto may be desired. In the event that radiation-curing may in some cases be required for the adhesive, moreoever, it is evident that such subsequent curing may also be employable with the system of the invention. Clearly, of course, the technique is applicable with other articles than the illustrative cigarettes filter application; and further modifications will occur to those skilled in this art, such being considered to fall within the spirit and scope of the invention as defined in the appended claims.

What is claimed is:

1. A fluid adhesive applicator having, a plurality of fine-orifice spaced nozzles disposed in a plane and extending transversely of a predetermined region; means for drawing a web of material-to-be-coated longitudinally through said predetermined region in juxtaposition to the orifices of said nozzles; pumping means for extruding fluid adhesive simultaneously through said nozzles onto the web as a corresponding plurality of closely spaced beads of adhesive extending transversely across said web; shear edge means disposed a short distance longitudinally beyond said orifices; the web carrying said beads from said nozzles to said shear edge means; and periodically activated bumper means disposed on the opposite side of the web from the edge means for bumping said plurality of adhesive beads carried by the web against said edge means to cause spreading of the beads into longitudinally intermittent bands of adhesive having a width in the range extending from bands of parallel stripes corresponding to the width of said beads to a merged-uniform continuous coating band.

2. A fluid adhesive applicator as claimed in claim 1 and in which further nozzle means is provided at a location beyond the first-named nozzles, connected to be simultaneously supplied with the adhesive from said pumping means, for applying supplemental continuous longitudinal adhesive lines to said web.

3. A fluid adhesive applicator as claimed in claim 2 and in which said further nozzle means is provided with extrusion orifices aligned with edges of the said coated bands to produce said longitudinal adhesive lines therealong and therebetween.

4. Apparatus as claimed in claim 2 and in which the web drawing means is positioned to draw the web upwardly juxtaposed to the said plane of the orifices of the first-named nozzles and substantially laterally past the further nozzle means.

5. A fluid adhesive applicator as claimed in claim 1 and in which means is provided for adjusting at least one of the dimension between the said shear edge means and the axis of the said orifices, and the dimension of the said short distance to vary the longitudinal width of the said bands.

6. A fluid adhesive applicator as claimed in claim 1 and in which said shear edge means is formed by a recess extending inward from said plane of the nozzle orifices.

7. Apparatus as claimed in claim 1 and in which the said plurality of nozzle orifices is divided into two groups spaced transversely from one another to define a space on the web between the resulting intermittent pairs of adhesive coating bands produced by the said groups.

8. Apparatus as claimed in claim 7 and in which said web comprises cigarette filter paper, and means is provided for cutting the same into sections and wrapping the sections about butted cigarette filters, with the bands of each of said pair of coating bands beng adhered to said filters.

9. Apparatus as claimed in claim 8 and in which further nozzle means is provided at a location beyond the first-named nozzles, connected to be simultaneously supplied with the adhesive from said pumping means, for applying supplemental continuous longitudinal adhesive lines along and between the edges of said coating bands for adhering to the head and tail edges of said filter.

* * * * *